US012433471B2

(12) United States Patent
Lee et al.

(10) Patent No.: US 12,433,471 B2
(45) Date of Patent: Oct. 7, 2025

(54) DISHWASHER

(71) Applicant: SAMSUNG ELECTRONICS CO., LTD., Suwon-si (KR)

(72) Inventors: Changwook Lee, Suwon-si (KR); Seunggee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 240 days.

(21) Appl. No.: 18/093,491

(22) Filed: Jan. 5, 2023

(65) Prior Publication Data

US 2023/0148832 A1 May 18, 2023

Related U.S. Application Data

(63) Continuation of application No. PCT/KR2021/006611, filed on May 27, 2021.

(30) Foreign Application Priority Data

Jul. 6, 2020 (KR) ..... 10-2020-0082755

(51) Int. Cl.

| | |
|---|---|
| ***A47L 15/50*** | (2006.01) |
| ***A47L 15/00*** | (2006.01) |
| ***A47L 15/14*** | (2006.01) |
| ***A47L 15/42*** | (2006.01) |

(52) U.S. Cl.

CPC ..... *A47L 15/50* (2013.01); *A47L 15/0021* (2013.01); *A47L 15/14* (2013.01); *A47L 15/4223* (2013.01)

(58) Field of Classification Search

None

See application file for complete search history.

(56) References Cited

U.S. PATENT DOCUMENTS

| | | | |
|---|---|---|---|
| 5,957,557 | A | 9/1999 | Langer et al. |
| 8,182,616 | B2 | 5/2012 | Kuecuek et al. |
| 2008/0035183 | A1 | 2/2008 | Kuecuek et al. |

FOREIGN PATENT DOCUMENTS

| | | | |
|---|---|---|---|
| CN | 110731738 | A | 1/2020 |
| CN | 110786796 | A | 2/2020 |
| CN | 210055922 | U | 2/2020 |
| JP | 2501055 | Y2 | 6/1996 |

(Continued)

OTHER PUBLICATIONS

CN_210055922 and translation (Year: 2020).*

(Continued)

*Primary Examiner* — Rita P Adhlakha

(74) *Attorney, Agent, or Firm* — STAAS & HALSEY LLP

(57) ABSTRACT

A dishwasher comprising: a first body; and a second body which includes a rack to hold an object to be washed, a spray nozzle to spray water onto the object, and a washing channel connectable to the spray nozzle, where the second body is coupleable to or coupleable from a top surface of the first body. The first body includes a washing pump to supply water, a supply channel to supply the water to the washing channel, a drain port to receive the water from the second body, and an upper housing which is coupleable to an opening formed at an upper surface of an external support such that so that while the upper housing is coupled to the opening the first body is positioned at a lower end of the upper surface of the external support.

15 Claims, 12 Drawing Sheets

(56) References Cited

FOREIGN PATENT DOCUMENTS

| | | | |
|---|---|---|---|
| JP | 2875795 | B2 | 3/1999 |
| JP | 2002-051958 | A | 2/2002 |
| KR | 10-0245132 | B1 | 2/2000 |
| KR | 10-2007-0039545 | A | 4/2007 |
| KR | 10-1665355 | B1 | 10/2016 |
| KR | 10-1749113 | B1 | 6/2017 |
| KR | 10-1757580 | | 7/2017 |
| KR | 10-2104549 | B1 | 5/2020 |
| WO | WO 97/33511 | A1 | 9/1997 |

OTHER PUBLICATIONS

International Search Report issued in International Application No. PCT/KR2021/006611 dated Sep. 28, 2021.
Written Opinion issued in International Application No. PCT/KR2021/006611 dated Sep. 28, 2021.

* cited by examiner

DISHWASHER

CROSS-REFERENCE TO RELATED APPLICATION(S)

This application is a continuation application, under 35 U.S.C. § 111 (a), of international application No. PCT/KR2021/006611, filed on May 27, 2021, which claims priority to Korean Patent Application No. 10-2020-0082755, filed Jul. 6, 2020, in the Korean Intellectual Property Office, the disclosures of which are incorporated by reference herein in their entirety.

BACKGROUND

Field

The disclosure relates to a dishwasher having an improved structure to improve usability of installation space and washing power.

Description of Related Art

A dishwasher is a device for washing dishes by spraying water onto the dishes.

As a configuration of a general dishwasher, the dishwasher includes a machine room including a sump, a washing pump, and the like inside a main body thereof, a washing tub, a basket installed inside the washing tub to accommodate dishes, and a spray nozzle for spraying water, etc. The water sprayed from the spray nozzle by the washing pump is capable of washing the dishes.

In order to supply and discharge water, it is essential to install a water supply structure for receiving water supplied from the outside and a drainage structure in the dishwasher. In addition, in order to increase washing efficiency and spray high-pressure water, a machine room having a high-performance pump and sump structure is required.

Based on the installation method, conventional dishwashers may be classified into: a built-in dishwasher that is installed in an empty space provided by detaching a part of a furniture cabinet, which is an external support; a free-standing dishwasher that may be placed independently; a counter-top dishwasher that is placed on an upper counter of a furniture cabinet or the like; and an in-sink dishwasher that is manufactured and installed integrally with a sink.

The built-in dishwasher has a lot of restrictions in installation space because it is bulky and requires a separate space provided by removing a part of a furniture cabinet, and the free-standing dishwasher has limitations for home use because it occupies a large space in a kitchen due to its large volume. In addition, the counter-top dishwasher and the in-sink dishwasher, which have a relatively small volume, have a limitation in securing a volume of a machine room, resulting in weak washing power, and also have such a small internal space that the number of accommodatable dishes is limited.

Therefore, there has been a demand for a dishwasher capable of securing washing power by increasing a volume of a machine room while increasing usability of space.

SUMMARY

According to an embodiment of the disclosure, a dishwasher includes: a first body; and a second body including a rack configured to hold an object to be washed, a spray nozzle configured to spray water onto the object, and a washing channel connectable to the spray nozzle, the second body being coupleable to or decoupleable from an upper surface of the first body. The first body includes a washing pump configured to supply water, a supply channel configured to supply the water to the washing channel of the second body, a drain port configured to receive the water from the second body, and an upper housing coupleable to an opening formed in an upper surface of an external support so that while the upper housing is coupled to the opening the first body is positionable at a lower end of the upper surface of the external support.

The drain port may be in a predetermined area of the first body, and the second body may include a drain housing having an opening at a position opposite to a position of the drain port.

The first body may further include a valve at an upper portion of the drain port to selectively open or close an upper portion of the first body, and when the second body is coupled to the first body, the valve may move downward so that a flow path is formed between the drain housing and the drain port.

The first body may include a fixing plate positioned above a center of the drain port, with an upper surface of the fixing plate having an area smaller than a cross-sectional area of the drain port, the valve may have a shape to surround the fixing plate, and while the second body is decoupled from the first body, the valve may be positioned on a side surface of the fixing plate by moving upward.

The second body may further include a fixing groove formed in a central portion of the drain housing, and the fixing groove may have a bent shape corresponding to a shape of the fixing plate to fix the second body in contact with the fixing plate when the second body is coupled to the first body.

The first body may include a coupling housing at the upper portion of the first body, and having a shape to support the second body while the second body is coupled to the first body and surround the valve while the second body is decoupled from the first body.

When the second body is decoupled from the first body, the fixing plate, the valve, and the coupling housing may be positioned on the same plane.

The dishwasher may further include a cover configured to selectively cover the upper surface of the first body, and the cover may cover the first body in a state where an upper surface of the cover is parallel to the upper surface of the external support.

The cover may have a shape corresponding to a shape of the upper surface of the first body and a shape of the upper surface of the second body to selectively cover one of the upper surface of the first body and the upper surface of the second body.

The cover may be coupled to the first body to open or close the upper surface of the first body in a door type.

The rack may include a first rack and a second rack, the second body may include a first housing forming an exterior of the first rack, a second housing forming an exterior of the second rack, and a hinge connecting one side of the first housing and one side of the second housing to each other, and the other side of the first housing and the other side of the second housing may be selectively joined together or separated from each other.

The dishwasher may further include: a sensor configured to detect whether the second body is coupled; and a control processor configured to operate the washing pump based on a detection result of the sensor.

The dishwasher may further include a third body, and the second body may further include a joining member selectively joined to the third body.

The second body may further include a delivery channel configured to provide the water delivered from the supply channel to the third body.

The third body may further include a second spray nozzle configured to spray water, and a second washing channel configured to receive the water delivered from the delivery channel, the second washing channel being connected to the second spray nozzle.

The third body may further include a third rack configured to hold additional objects to be washed, and the second spray nozzle may spray the water onto the additional objects to be washed.

The second spray nozzle may also spray the water onto the object held on the rack of the second body to be washed.

The dishwasher may further include: a sensor configured to detect whether the second body and the third body is coupled; and a control processor configured to control the washing pump to be operated at a first strength while the second body is coupled to the first body, and to be operated at a second strength stronger than the first strength while the first body and the third body are sequentially coupled to one another.

The dishwasher may further include a cover having a shape corresponding to a shape of the upper surface of the first body, a shape of the upper surface of the second body, and a shape of the upper surface of the third body to selectively cover one of the upper surface of the first body, the upper surface of the second body, and the upper surface of the third body.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
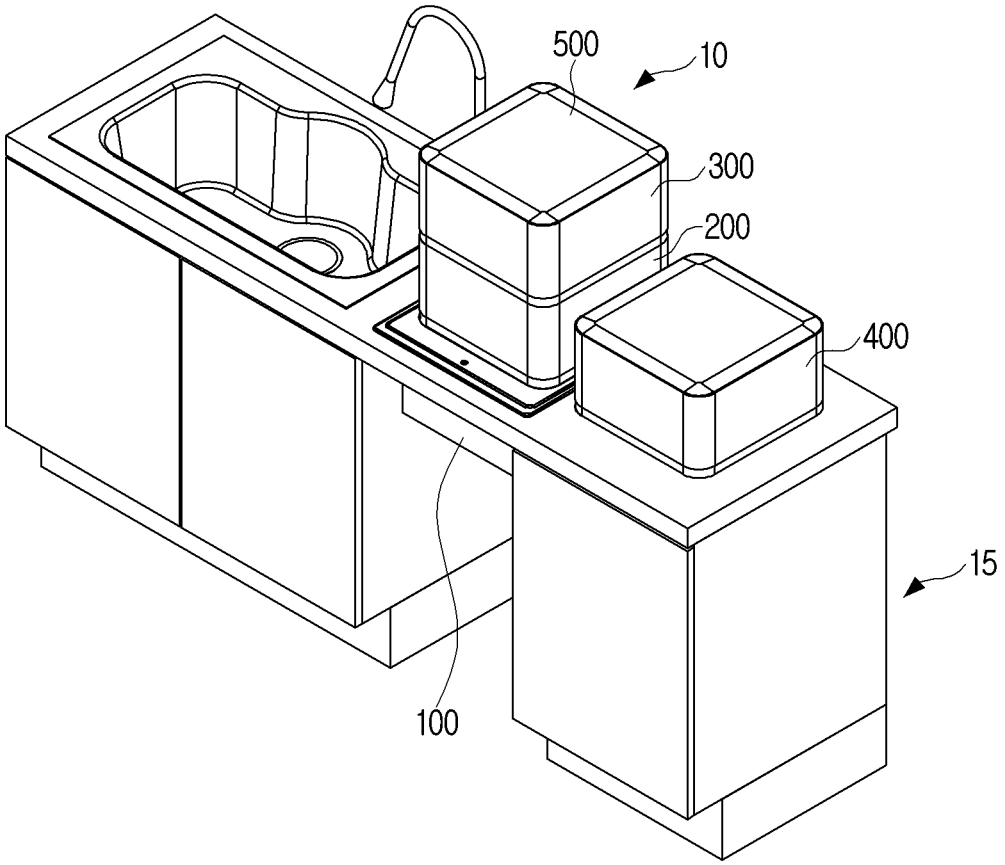
FIG. 1 is a perspective view illustrating a dishwasher installed on an external support according to an embodiment of the disclosure.

Hereinafter, embodiments of the disclosure will be described in more detail with reference to the accompanying FIGS. 1 to 9. The embodiments to be described below will be embodiments most suitable for understanding the technical features of the disclosure. Such embodiments do not limit the technical features of the disclosure, but exemplify that the disclosure may be implemented like the embodiments to be described below.

Therefore, the disclosure may be variously modified within the technical scope of the disclosure through the embodiments to be described below, and such modifications will fall within the technical scope of the disclosure. In addition, concerning the reference signs provided in the accompanying drawings to help the understanding of the embodiments to be described below, related components among components having the same function between the embodiments are denoted by the same or extending reference numerals.

The disclosure provides a dishwasher having an improved structure to improve both usability of installation space and washing power.

The dishwashers according to various embodiments of the disclosure are advantageous in that washing power can be improved by increasing a volume of a machine room and usability of installation space can be improved.

FIG. 1 is a perspective view illustrating a dishwasher 10 installed on an external support according to an embodiment of the disclosure.

Referring to FIG. 1, the dishwasher 10 may include a first body 100, a second body 200, a third body 300, and a fourth body 400. Specific structures of the first body 100 to the fourth body 400 will be described in detail below.

The first body 100 may include an upper housing 140 coupled to an opening formed in an upper surface of the external support to position the first body at a lower end of the upper surface of the external support. As a result, the first body 100 may be installed on the external support 15 such as a furniture cabinet.

Although it is illustrated as an example, for convenience of explanation, that the first body 100 is installed in a counter of the furniture cabinet that is the external support 15, the installation structure of the first body 100 is not limited thereto, and the first body 100 including the upper housing 140 may be fixed to any type of external support 15.

As in the embodiment of FIG. 1, the upper housing 140 may have a structure to contact the upper surface of the external support 15 around the opening in which the first body 100 is positioned. As a result, the first body 100 is fixed by the upper housing 140, and the upper housing 140 is fixed to the external support 15, thereby fixing an upper portion of the first body 100 to the external support 15.

The upper surface of the external support 15 contacting the upper housing 140 may have a separate support groove corresponding to a shape of the upper housing 140, and the support groove may have the same height as the upper housing 140. Therefore, the upper surface of the external support 15 to which the upper housing 140 is coupled may maintain a smooth plate shape without a curve.

Although not illustrated in the drawings, the upper housing 140 may be coupled to the counter of the external support 15 in a sliding manner.

The upper housing 140 may be fixed inside the external support 15 to support a side surface or a lower surface of the first body 100. In this case as well, the upper housing 140 may have a structure to fix the first body 100 and position an upper surface of the first body 100 in the opening of the upper surface of the external support 15, so that the first body 100 is not exposed to the upper surface of the external support 15.

For a built-in dishwasher, it is required to make a space by completely decoupling a part of a storage closet of the furniture cabinet that is the external support 15, and the storage closet needs to be reformed elaborately such that its upper surface serves as a support. In addition, if a width of a furniture cabinet designed to be disassembled does not exactly match the specifications of the dishwasher, it is required to reform three or more pieces of the furniture cabinet to install the dishwasher. In a case where the dishwasher is replaced after the furniture cabinet is reformed, there are more restrictions.

In the dishwasher 10 according to an embodiment of the disclosure, it is only needed to provide an opening in the counter of the furniture cabinet, which is the upper surface of the external support 15, in accordance with the specifications of the upper housing 140 of the first body 100 in a reformed manner. Therefore, a dishwasher in this type may be more convenient to install than a dishwasher in built-in type.

In addition, a built-in dishwasher and a counter-top dishwasher, which are generally used for home use, have limitations in increasing a volume of a machine room in which a motor, a pump, etc. are disposed. In contrast, in the dishwasher 10 according to an embodiment of the disclosure, only the first body 100 including a sump 110, a circulation pump 117, a washing pump 105, etc. is positioned inside the furniture cabinet, thereby making it possible to form the first body 100 to have a relatively larger volume than those in other types of dishwashers. As a result, it is possible to improve the performance of the dishwasher 10 by increasing a water spraying power of the dishwasher 10 and enhancing a washing power and a drying power.

Therefore, due to the feature in which the first body 100 is positioned in the opening of the upper surface of the external support 15, the dishwasher 10 according to the disclosure can secure a larger volume of the machine room than a conventional dishwasher for home use, resulting in an improvement in performance, and is more convenient to install than a dishwasher in built-in type.

The second body 200 may be coupled to or decoupled from the upper surface of the first body 100. The structures of the second body 200 to the fourth body 400 may be different from each other, or may be similar or identical to each other.

Although not illustrated in the drawings, racks and spray nozzles in the second body 200 to the fourth body 400 may have different structures to be distinguishably used, for example, according to types of dishes that are objects to be washed.

For convenience of explanation, a component coupled to the first body 100 will be referred to as the second body 200, a component coupled to the second body 200 will be referred to as the third body 300, and a separated component will be referred to as the fourth body 400.

The second body 200 may be connected to the first body 100 for supply and drainage of water. The second body 200 may be selectively fixed to the first body 100, by forming the upper surface of the first body 100 and the lower surface of the second body 200 to have a corresponding shape and contact each other, or by including a connecting member such as a joint or a curve.

The second body 200 may be fixed to the first body 100 when the dishwasher 10 is in operation, and may otherwise be used for various purposes such as a dish drying rack or a dish storage box while being separated from the first body 100.

Since the second body 200 is detachable and the first body 100 is positioned inside the furniture cabinet that is the external support 15, the dishwasher 10 according to the disclosure does not always occupy a space on the counter of the furniture cabinet, making it possible to improve the space utilization of the counter.

Since the second body 200 is fixed to or separated from the upper surface of the first body 100 positioned in the opening of the counter, when moving objects to be washed from the counter to the dishwasher 10, the second body 200 may be moved only in a horizontal direction on the counter.

Therefore, a user does not need to move a rack 210 filled with objects to be washed in a vertical direction to use the dishwasher 10 as in an in-sink dishwasher or a built-in dishwasher, which is advantageous in that the user does not bear the load of the rack 210 filled with the objects to be washed.

In addition, the second body 200 may be detachable and easily movable, which is advantageous in that the dishwasher 10 can be used in an easy way, because the user brings the second body 200 directly onto a table, puts used dishes into the second body 200, and fixes the second body 200 to the first body 100, rather than collecting the used dishes, moving the used dishes to a position near the dishwasher 10, and then placing the used dishes on the rack 210.

Figure 2:
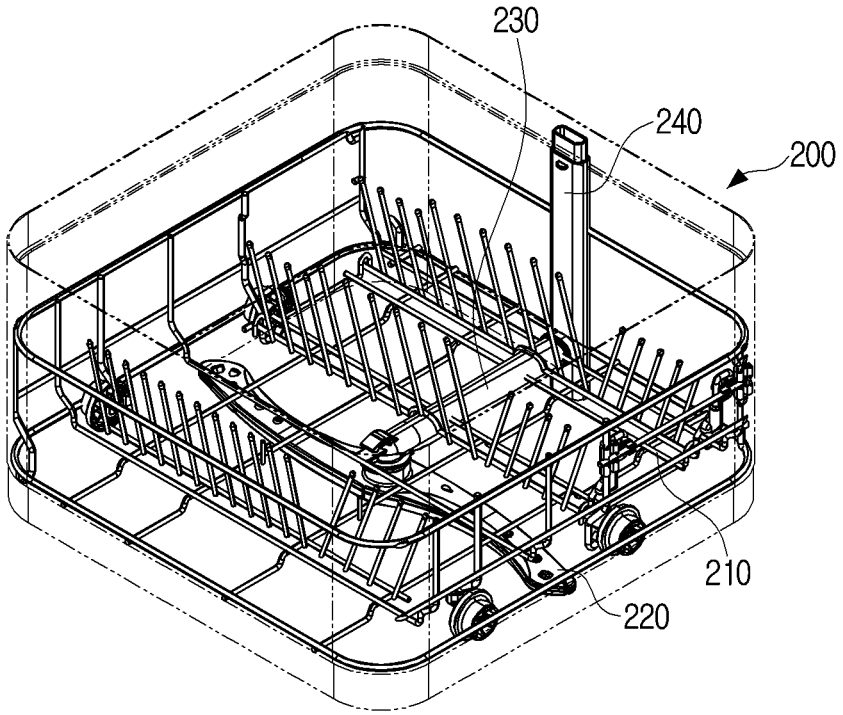
FIG. 2 is a perspective view illustrating a second body according to an embodiment of the disclosure.

FIG. 2 is a perspective view illustrating the second body 200 according to an embodiment of the disclosure.

Referring to FIG. 2, the second body 200 may include a rack 210, a first spray nozzle 220, a first washing channel 230, and a delivery channel 240.

The rack 210 may hold objects to be washed. The rack 210 may have a shape to hold objects to be washed. Also, the rack 210 may be coupled to or decoupled from the second body 200, and may include a separate holder for holding a spoon or a baby bottle.

The objects to be washed by the dishwasher 10 may include, but are not limited to, not only dishes such as bowls, plates, and cups, and cutlery such as spoons, chopsticks, knives, and forks but also frying pans, pots, and ladles.

The rack 210 may enable the objects to be washed to stand in a tilted state to cause water sprayed from an upper surface or a lower surface thereof to evenly contact each of the objects to be washed throughout its entire area.

The rack 210 may be made of a material having high thermal conductivity with rigidity, such as a synthetic material, e.g., metal or plastic.

The first spray nozzle 220 may spray water onto objects to be washed. The first spray nozzle 220 may include a plurality of nozzles, and may spray water at a strong pressure. The first spray nozzle 220 may have various shapes to evenly spray the water onto the objects to be washed.

The first spray nozzle 220 may be disposed below the rack 210 to spray water in an upward direction as illustrated in FIG. 2, or may be disposed above the rack 210 to spray water downward, or may also be disposed to extend to a side surface of the rack 210 to evenly spray water onto the objects to be washed.

The first spray nozzle 220 may have a washing wing shape as illustrated in FIG. 2. The wing-shape structure may be divided into two opposite sides and may rotate about its central portion. The rotation of the first spray nozzle 220 may be realized by the pressure at which the water is delivered. The first spray nozzle 220 may change a rotation direction to spray the water onto the objects to be washed in a different direction, thereby increasing the washing power.

The spraying direction and the spraying pressure of the first spray nozzle 220 may be controlled by the washing pump 105 of the first body 100, and the washing pump 105 may be controlled by a control processor 550 of the dishwasher 10.

The first washing channel 230 may be connected to the first spray nozzle 220 to supply water. The first washing channel 230 may receive the water supplied from a supply channel 120 of the first body 100, and may supply the water to the delivery channel 240 if the third body 300 is connected to the second body 200. A relationship between the first washing channel 230 and the delivery channel 240 will be described with reference to FIG. 9 below.

Figure 3:
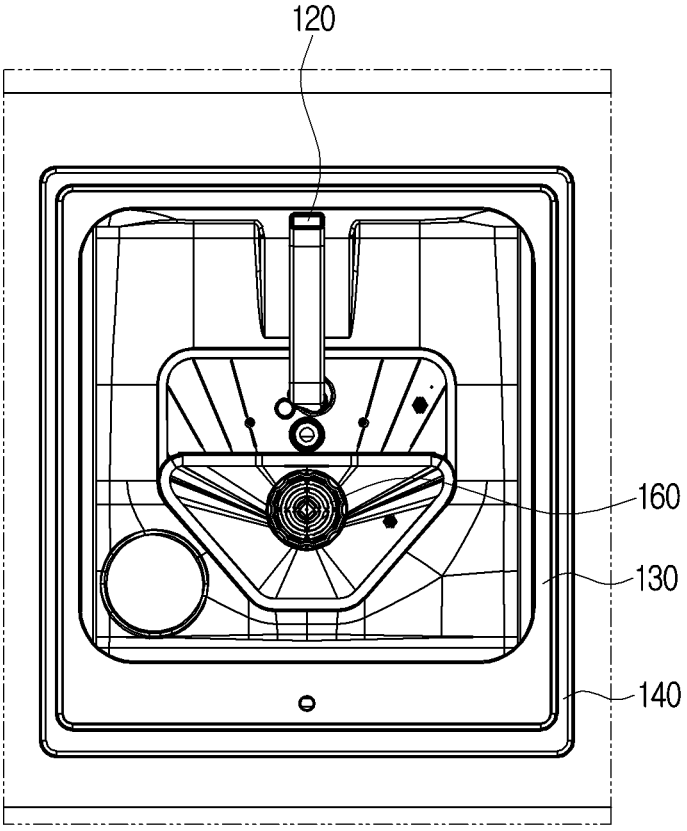
FIG. 3 is a plan view illustrating a first body according to an embodiment of the disclosure.

FIG. 3 is a plan view illustrating the first body 100 according to an embodiment of the disclosure.

Referring to FIG. 3, the first body 100 may include a supply channel 120, a drain port 160, and a coupling housing 130.

The supply channel 120 may receive the water delivered from the washing pump 105, and supply the water to the first washing channel 230 in a state where the second body 200 is coupled to the first body 100.

Although not illustrated in the drawings, the supply channel 120 may have a separate opening/closing device. An opening/closing operation of the supply channel 120 may be controlled by a user or by the control processor 550. Alternatively, the supply channel 120 may be provided with a separate opening/closing stopper. The opening/closing stopper may be opened when the supply channel 120 is coupled to the first washing channel 230 of the second body 200 to couple the first body 100 to the second body 200, and the opening/closing stopper may be closed when the supply channel 120 is decoupled from the first washing channel 230.

For example, since the supply channel 120 is basically a one-way flow channel through which water moves only upward, an opening/closing structure is formed at an end of the supply channel 120 to be pushed only downward, so that water is not supplied upward in a state where the second body 200 is not coupled to the first body 100, and the first washing channel 230 of the second body 200 is connected to the supply channel 120 by pushing the opening/closing structure downward, thereby structurally preventing in advance a problem that water is sprayed from the supply channel 120 when the second body 200 is not coupled to the first body 100.

The drain port 160 may accommodate the water having been used for washing the objects to be washed in the second body 200 as the water is delivered to the first body 100, and may include a separate filtering structure.

Like a filter net in a sink drain, the filtering structure filters out solid matter such as food contained in the water, and allows only the water to pass through the first body 100. The filtering structure protrudes upward from the first body 100 to prevent the drain port 160 from being clogged.

Figure 5A:
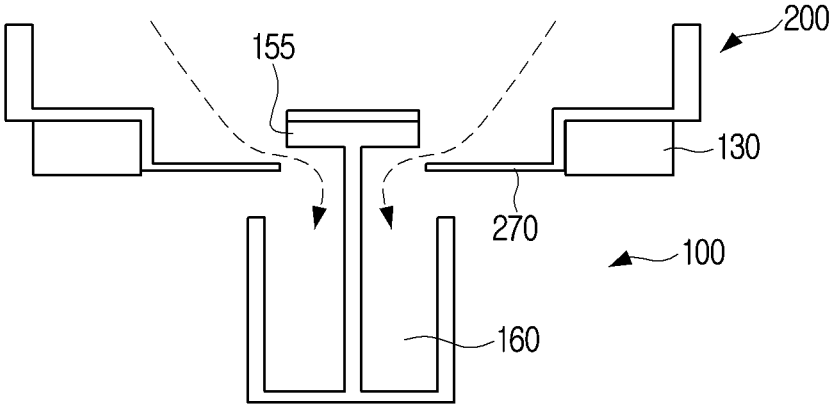
FIG. 5A is a cross-sectional view illustrating the first body and the second body of the dishwasher according to an embodiment of the disclosure.
Figure 5B:
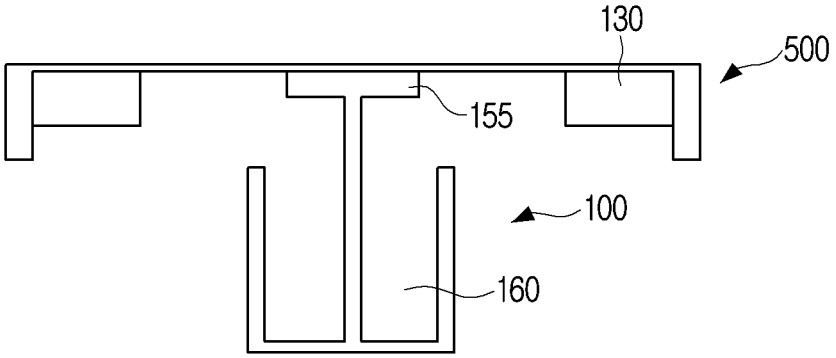
FIG. 5B is a cross-sectional view illustrating the first body and a cover of the dishwasher according to an embodiment of the disclosure.

The drain port 160 may be opened and closed either manually or by the control processor 550, but the opening/closing of the drain port 160 may be realized in a structurally easy way by coupling the first body 100 and the second body 200 to each other as illustrated in FIGS. 5A and 5B to be described below.

Figure 4:
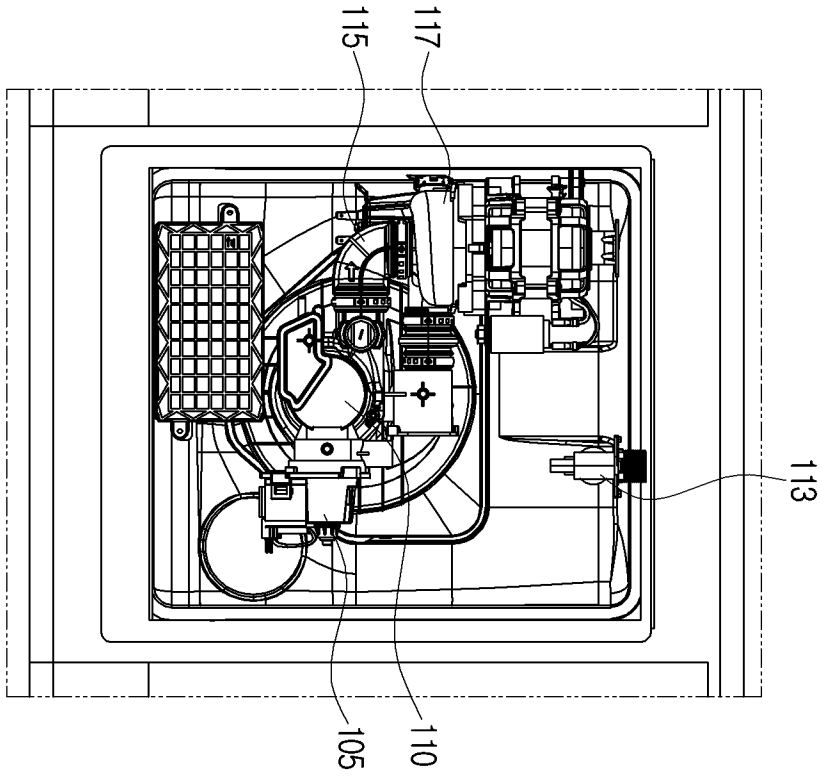
FIG. 4 is a bottom view illustrating the first body according to an embodiment of the disclosure.

FIG. 4 is a bottom view illustrating the first body 100 according to an embodiment of the disclosure.

Referring to FIG. 4, the first body 100 includes a sump 110, a washing pump 105, a circulation channel 115, a circulation pump 117, etc., and may further include a heating device, a control processor 550, a detergent storage box, and a rinse storage box, etc.

Hereinafter, circulation of water in a structure including the sump 110, which corresponds to the machine room of the dishwasher 10, will be described.

The water introduced through a water supply pipe 113 is stored in the sump 110. The water is delivered from the sump 110 to the supply channel 120 by the washing pump 105, and the water is sprayed at a high pressure from the first spray nozzle 220 of the second body 200 according to a pressure level of the washing pump 105 during a washing process to wash the objects to be washed. The sprayed water may fall after being used for washing the objects to be washed, and then may be delivered back to the first body 100 through the drain port 160.

The delivered water may be drained directly to the outside, or may be stored in the sump 110. The circulation pump 117 may circulate the water stored in the sump 110 through the circulation channel 115, and purify the water through a filter. The filth purified by the filter may be discharged to the outside.

During the washing process, the detergent storage box and the rinse storage box may deliver a detergent and a rinse to the water.

In the washing process, the above-described process is repeated one or more times, and the water is circulated by the sump 110 when used.

A drying method may be a hot air drying method in which hot air is applied and circulated, or a latent heat drying method in which latent heat is used by spraying high-temperature water.

The heating device may heat water and spray the heated water to increase a temperature of the objects to be washed, so that residual moisture is removed by latent heat. The high-temperature water may have a sterilizing effect.

Through these washing, sterilizing, and drying processes, the dishwasher 10 washes objects to be washed. Therefore, the performance of the dishwasher 10 may be determined by the configuration including the washing pump 105 and the sump 110 installed in the machine room.

In particular, the washing pump 105 is a structure including a motor. In order to improve the performance of the washing pump 105, a large-volume motor and pump structure has been required.

In general, in a built-in dishwasher and a counter-top dishwasher, which are commonly used at home, a washing tub accommodating objects to be washed takes up a lot of space. In order to increase a capacity for accommodating objects to be washed, there is a limit in securing the volume of the machine room.

As a result, there has not been enough space to accommodate a sump 110 and a washing pump 105 each having a large volume with improved performance, resulting in a deterioration in washing power, which is a purpose of the dishwasher 10. Accordingly, a home-use dishwasher, which has a weak cleaning power, has required a user to wash the objects to be washed in advance for primary washing and put them into the dishwasher 10.

However, in the dishwasher 10 according to the disclosure, by separating the first body 100 containing the sump 110 and the washing pump 105, etc. from the second body 200 for accommodating objects to be washed, and disposing only the first body in the furniture cabinet that is the external support 15, the sump 110 and the washing pump 105 can be provided in a larger size in the same furniture cabinet, which is advantageous in improving a washing power and a drying power.

FIG. 5A is a cross-sectional view illustrating the first body 100 and the second body 200 of the dishwasher 10 according to an embodiment of the disclosure.

Referring to FIG. 5A, the first body 100 may further include a drain port 160, a coupling housing 130, and a fixing plate 155, and the second body 200 may further include a drain housing 270.

The water delivered from the second body 200 may flow into the drain port 160. The drain port 160 may be disposed in a predetermined area of the first body 100, and may be connected to the sump 110, or the water may be directly delivered to the circulation channel 115 for a filtering process.

The drain housing 270 may have an opening at a position opposite to the position of the drain port 160 to induce the water to be discharged from the second body 200 to the first body 100 and delivered directly to the drain port 160.

Figure 6A:
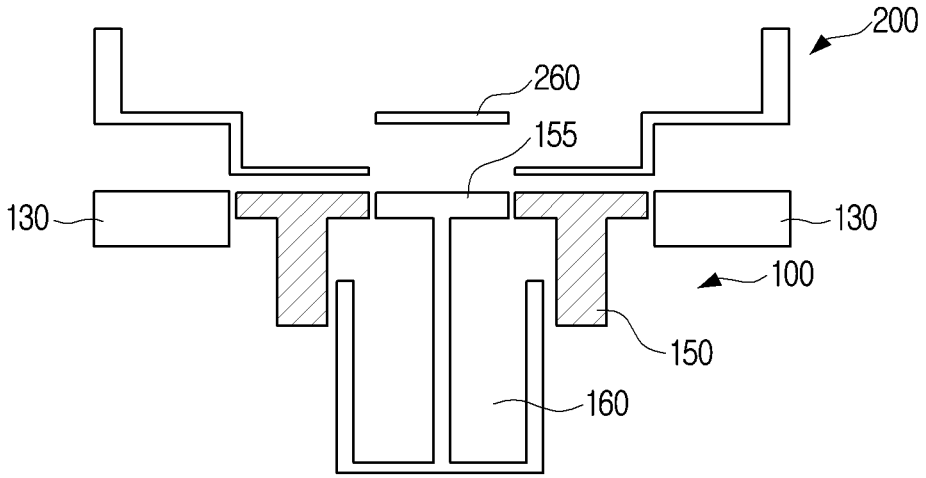
FIGS. 6A and 6B are cross-sectional views each illustrating a drainage structure between the first body and the second body according to an embodiment of the disclosure.
Figure 6B:
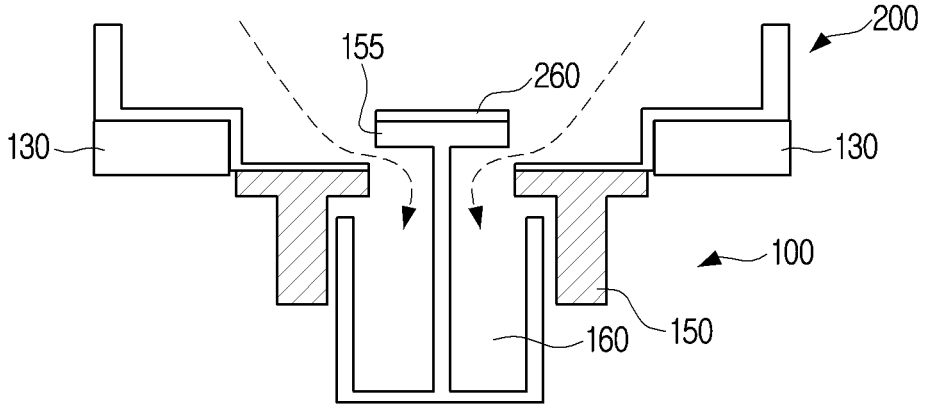

The drain housing 270 may have a shape to protrude downward, and may form a flow path to enable the water to flow thereinto. The drain housing 270 may have a step shape as illustrated in FIGS. 6A and 6B, but is not limited thereto, and may be inclined at an angle or have a funnel shape.

Due to the protruding shape of the drain housing 270, the drain housing 270 may have a structure to push the valve 150 downward to be fixed to the coupling housing 130 to couple the second body 200 to the first body 100. This structure will be described with reference to FIGS. 6A and 6B below.

FIG. 5B is a cross-sectional view illustrating the first body 100 and a cover 500 of the dishwasher 10 according to an embodiment of the disclosure.

Referring to FIG. 5B, the dishwasher 10 may further include a cover 500 capable of selectively covering the upper surface of the first body 100.

The cover 500 may be coupled to the upper surface of the first body 100 from which the second body 200 is decoupled, to cover the first body 100 and the drain port 160. The shape and the structure of the cover 500 are not limited, but the cover 500 may have a structure to be coupled and fixed to the coupling housing 130 of the first body 100. The cover 500 will be described in detail with reference to FIGS. 7A and 7B.

FIGS. 6A and 6B are cross-sectional views each illustrating a drainage structure between the first body and the second body 200 according to an embodiment of the disclosure.

Referring to FIGS. 6A and 6B, the first body 100 may further include a valve 150, and the second body 200 may further include a fixing groove 260.

The valve 150 may be disposed at an upper portion of the drain port 160 to selectively open or close the upper portion of the first body 100.

The valve 150 may have a structure to entirely open or close the drain port 160, or may be disposed at the upper portion of the drain port 160 as illustrated in FIG. 6A to open or close the upper portion of the first body 100, thereby opening or closing the drain port 160 existing in the first body.

The valve 150 may have a structure to move downward when external pressure is applied thereto, and move upward back when the pressure is eliminated.

The movement of the valve 150 may be controlled by a user or by the control processor 550, or the valve 150 may be structurally moved due to its elastic force.

The valve 150 may open or close the upper portion of the first body 100. When the second body 200 is coupled to the first body 100, the valve 150 may move downward to form a flow path between the drain housing 270 and the drain port 160.

Although not illustrated in the drawings, when the second body 200 is coupled to the first body 100 in a state where one side of the valve 150 is fixed to the first body 100, the other side of the valve 150 may be pushed downward to form a flow path between the drain housing 270 and the drain port 160.

If the drain port 160 is open at all times, odors may come out of the water delivered after being used for washing as well as filth, or foreign substances may flow into the sump 110 and cause malfunction. Therefore, the valve 150 may move only when the second body 200 is coupled to the first body 100 to form a flow path to the drain port 160, and close the flow path to close the drain port 160 when the second body 200 is decoupled from the first body 100.

Although not illustrated in the drawings, when the second body 200 is coupled to the first body 100 in a state where one side of the valve 150 is fixed to the first body 100, the other side of the valve 150 may be pushed downward to form a flow path between the drain housing 270 and the drain port 160.

The fixing plate 155 may be positioned above the center of the drain port 160, and an upper surface of the fixing plate 155 may have an area smaller than a cross-sectional area of the drain port 160. When the second body 200 is decoupled from the first body 100, the valve 150 may be positioned on a side surface of the fixing plate 155 by moving upward.

The fixing plate 155 may have a plate shape with its lower surface being supported by a column. Although not illustrated in the drawings, the fixing plate 155 may have a shape to be connected to the upper portion of the first body 100 to be supported laterally.

As illustrated in FIG. 6B, the fixing groove 260 may be formed in a central portion of the drain housing 270 and may have a bent shape corresponding to the shape of the fixing plate 155.

When the second body 200 is connected to the first body 100, the fixing groove 260 may fix the second body 200 in contact with the fixing plate 155. In a state where the second body 200 is coupled to the first body 100, the fixing groove 260 and the fixing plate 155 may serve as s connecting members, while preventing the second body 200 from escaping.

The coupling housing 130 may be disposed at the upper portion of the first body 100, and may have a shape to support the second body 200 when the second body 200 is connected to the first body 100 and surround the valve 150 when the second body 200 is disconnected from the first body 100.

When the second body 200 is disconnected from the first body 100, the fixing plate 155, the valve 150, and the coupling housing 130 may be positioned on the same plane. As a result, the first body 100, from which the second body 200 is disconnected, can be disposed on the horizontally same plane as the counter of the furniture cabinet, which is the upper surface of the external support 15. With this structure, when the user does not use the dishwasher 10, the upper surface of the first body 100 can be used as a counter.

Therefore, unlike a counter-top dishwasher and a free-standing dishwasher, the dishwasher 10 according to the disclosure does not occupy a separate space in a kitchen, and does not restrict the use of the counter of the furniture cabinet, which is the upper surface of the external support 15, when the dishwasher 10 is not used, thereby making it possible to enhance space utilization in installing and using the dishwasher 10.

Figure 7A:
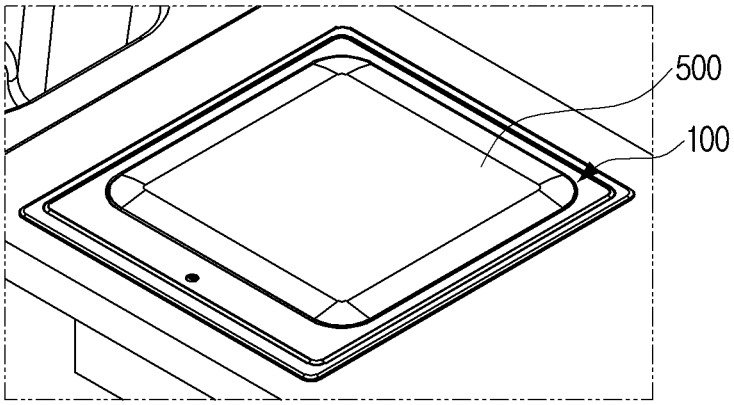
FIGS. 7A and 7B are perspective views each illustrating the first body and the cover according to an embodiment of the disclosure.
Figure 7B:
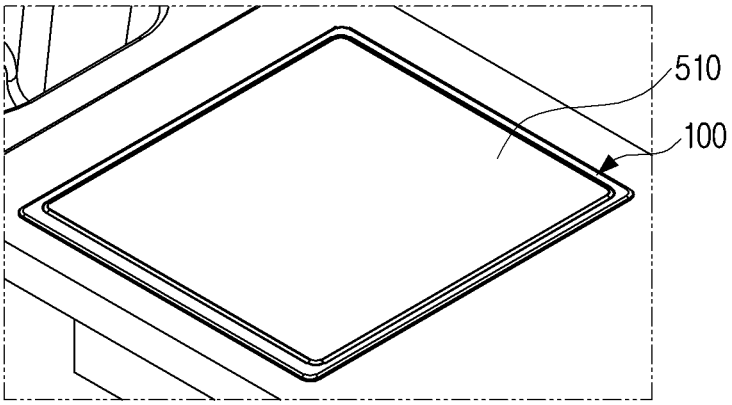

FIGS. 7A and 7B are perspective views each illustrating the first body and the cover 500 according to an embodiment of the disclosure.

As an example of the cover 500, the cover 500 of FIG. 5*b* may cover the upper surface of the first body 100 in a state in which the second body 200 is not coupled to the first body 100, and prevent the drain port 160, the supply channel 120, etc. from being exposed to the outside.

The upper housing 140 may be fixed such that the upper surface of the first body 100 and the upper surface of the external support 15 are parallel to each other, and the upper surface of the first body 100 is positioned at a lower height than the upper surface of the external support 15.

When the cover 500 covers the upper surface of the first body 100, an upper surface of the cover 500 may be parallel to the upper surface of the external support 15. Since the upper surface of the cover 500 is parallel to and flat with respect to the upper surface of the external support 15, when the upper surface of the external support 15 is used in a state where the second body 200 is not coupled to the first body 100, stuff can be placed on the upper surface of the cover 500, and thus, the space utilization of the dishwasher 10 can be enhanced. Further, while the upper surface of the cover 500 is formed at the same height as the upper surface of the external support 15, the upper surface of the external support 15 may form a flat plane.

As an example of the cover 500, a cover 500 of FIG. 7A may have a shape corresponding to the shape of the upper surface of the first body 100 and the shape of the upper surface of the second body 200 to selectively cover one of the upper surface of the first body 100 and the upper surface of the second body 200.

When the dishwasher 10 according to the disclosure is operated by coupling the second body 200 to the first body 100, the cover 500 may be attached to the upper surface of the second body 200 to prevent water from being sprayed to the outside. In addition, when the dishwasher 10 according to the disclosure is not operated by decoupling the second body 200 from the first body 100, the cover 500 may cover the upper surface of the first body 100.

As an example of the cover 500, a cover 510 of FIG. 7B may be coupled to the first body 100 to open or close the upper surface of the first body 100 in a door type.

One side of the cover 510 may be coupled to the upper surface of the first body 100 by a separate hinge to move upward or downward in an opening or closing manner. The cover 510 may cover the upper surface of the first body 100 in a state where the second body 200 is decoupled from the first body 100, and may be opened by moving upward about the hinge only when the second body 200 is coupled to the first body 100.

The cover 510 may be slidable to cover or open the upper surface of the first body 100 by sliding by a user or by the control processor 550.

Like the valve 150 described above, the covers 500 and 510 of FIGS. 5B, 7A, and 7B described above may close the drain port 160 to prevent odors that may come out of the drain port 160, and to protect the sump 110 by blocking foreign substances from flowing into the sump 110.

The covers 500 and 510 may increase the usability of the counter of the furniture cabinet, which is the upper surface of the external support 15, making it possible to enhance the space utilization of the dishwasher 10.

Figure 8:
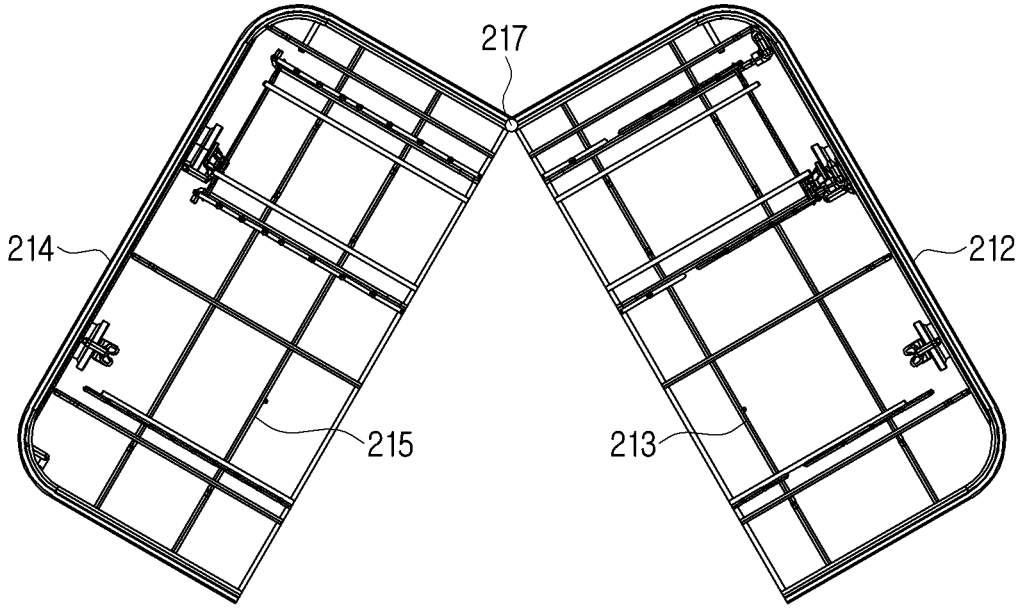
FIG. 8 is a plan view illustrating the second body according to an embodiment of the disclosure.

FIG. 8 is a plan view illustrating the second body 200 according to an embodiment of the disclosure.

The rack 210 may include a first rack 213 and a second rack 215, the second body 200 may include a first housing 212 forming an exterior of the first rack 213, a second housing 214 forming an exterior of the second rack 215, and a hinge 217 connecting one side of the first housing 212 and one side of the second housing 214 to each other, and the other side of the first housing 212 and the other side of the second housing 214 may be selectively joined together or separated from each other.

The second body 200 may be opened by the hinge 217 to increase convenience in taking objects to be washed into or out of the rack 210. Even in a case where the second body 200 is decoupled from the first body 100 for use as a dish drying rack and the dish rack 210, its usability can be increased.

Although not illustrated in the drawings, the rack 210 may be separated from the second body 200, and may have a different design and a different racking structure to secure aesthetics. Also, the rack 210 may be independently used as a dish rack 210 to exhibit additional functions.

Although not illustrated in the drawings, the dishwasher 10 according to an embodiment of the disclosure may further include a sensor 540 and a control processor 550.

The sensor 540 may detect whether or not the second body 200 is connected to the first body 100, and the control processor 550 may operate the washing pump 105 based on a detection result of the sensor 540.

The control processor 550 may control the operations of the washing pump 105, the circulation pump, the valve 150, the water supply pipe 113, etc.

The sensor 540 may transmit the detection result to the control processor 550, and the control processor 550 may operate the dishwasher 10 immediately. Alternatively, the control processor 550 may be used as a safety sensor based on the detection result of the sensor 540 to prevent malfunction of the dishwasher 10 when the second body 200 is not connected to the first body 100.

The sensor 540 may display the detection result on a control panel. When a user inputs an operation through the control panel, the control processor 550 may operate the washing pump 105, the circulation pump 117, etc. on the basis of an input value.

Figure 9:
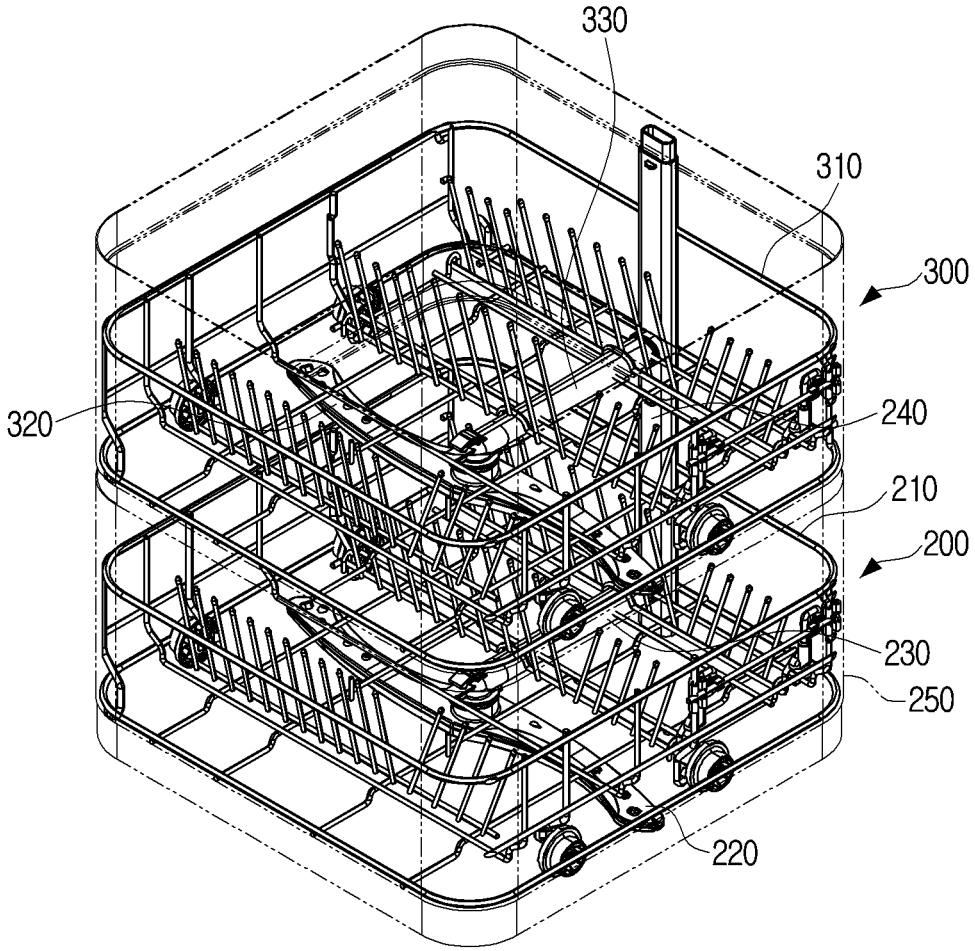
FIG. 9 is a perspective view illustrating the second body and a third body according to an embodiment of the disclosure.

FIG. 9 is a perspective view illustrating the second body 200 and the third body 300 according to an embodiment of the disclosure.

Referring to FIG. 9, the second body 200 may further include a joining member 250.

The second body 200 and the third body 300 may be selectively joined together by the joining member 250.

As illustrated in FIG. 9, the joining member 250 may be a housing in a structure having a joining groove to allow a lower surface of the third body 300 is joined to the upper surface of the second body 200. Alternatively, the joining member 250 may a joint formed to fix the third body 300 to the second body 200.

The third body 300 may also include a joining member, and the fourth body 400 may be joined to the third body 300 although not illustrated in the drawings. The joining members of the second body 200 and the third body 300 may have the same shape.

The delivery channel 240 may provide the water delivered from the supply channel 120 to the third body 300. Like the supply channel 120 of the first body 100, the delivery channel 240 may include a separate opening/closing device, and an opening or closing operation may be controlled by a user or by the control processor 550.

Although not illustrated in the drawings, the delivery channel 240 may have an opening/closing structure to be opened or closed, based on whether the delivery channel 240 is coupled to a second washing channel 330 of the third body 300, to couple the second body 200 to the third body 300.

The third body 300 may include a second spray nozzle 320 for spraying water and a second washing channel 330 receiving the water delivered from the delivery channel 240 and connected to the second spray nozzle 320.

The third body 300 may further include a third rack 310 for holding additional objects to be washed. The second spray nozzle 320 may spray the water onto the additional objects to be washed.

The second spray nozzle 320 may have the same shape as the first spray nozzle 220. The second spray nozzle 320 may be disposed at an upper portion of the third rack 310 to spray the water downward, or may be disposed to extend to a side surface of the third rack 310 to evenly spray the water onto objects to be washed.

The second spray nozzle 320 may have a structure to spray the water onto the objects held on the rack 210 of the second body 200 to be washed. As a result, the objects to be washed on the rack 210 of the second body 200 can be washed with the water sprayed from the first spray nozzle 220 and the second spray nozzle 320.

Although not illustrated in the drawing, the sensor 540 may detect whether or not each of the second body 200 and the third body 300 is connected, and the control processor 550 may control the washing pump 105 to be operated at a first strength when the second body 200 is connected to the first body 100, and to be operated at a second strength larger than the first strength when the first body 100 to the third body 300 are sequentially connected to one another.

In an embodiment of the disclosure in which the third body 300 is included, the cover 500 may have a shape corresponding to an upper surface of the third body 300 as well as the upper surface of the first body 100 and the upper surface of the second body 200 to selectively cover the upper surface of the third body 300 as well.

When the third body 300 is coupled to the second body 200, additional objects to be washed can be washed. This makes it possible to change a capacity for accommodating objects to be washed of the dishwasher 10 according to the disclosure.

As an example, each of the second body 200 and the third body 300 may have a capacity for accommodating objects to be washed for one person. For washing after using dishes for one person, only the second body 200 may be coupled. When the number of objects to be washed increases, not only the third body 300 but also the fourth body 400 may be coupled. That is, it is possible to adjust the number of dishes that the dishwasher 10 is capable of washing at once.

The capacity-changeable dishwasher 10 can reduce power consumption and water consumption caused when a large-capacity dishwasher 10 is operated to wash a small number of objects to be washed.

Even though the number of objects to be washed increases, a strong washing power can be secured by securing a capacity for the machine room as described above, which supplements the disadvantage of the conventional dishwasher 10. Therefore, the dishwasher 10 can be used from single-person households to multi-person households, while minimizing power consumption and water consumption.

In addition, since the second body 200 and the third body 300 can be detached freely, the second body 200 and the third body 300 can be easily replaced. Furthermore, even if a failure occurs in the machine room of the first body 100, the machine room can be easily opened and parts can be repaired to deal with the failure.

Although diverse embodiments of the disclosure have been each individually described above, each of the embodiments is not necessarily implemented alone, and the configuration and operation of each of the embodiments may be implemented in combination with at least one other embodiment.

In addition, although the preferred embodiments of the disclosure have been illustrated and described above, the disclosure is not limited to the specific embodiments as described above, and may be variously modified by those skilled in the art to which the disclosure pertains without departing from the gist of the disclosure as claimed in the appended claims. Such modifications should not be individually understood from the spirit or prospect of the disclosure.

What is claimed is:

1. A dishwasher, comprising:

a first body; and a second body including a rack configured to hold an object to be washed, a spray nozzle configured to spray water onto the object, and a washing channel connectable to the spray nozzle, the second body being coupleable to or decoupleable from an upper surface of the first body, wherein the first body includes:

a washing pump configured to supply water, a supply channel configured to supply the water to the washing channel of the second body, a drain port configured to receive the water from the second body, and an upper housing coupleable to an upper surface of an external support that is separate from the dishwasher, wherein, while the upper housing of the first body is coupled to the upper surface of the external support which has an opening, the first body is positionable at a lower end of the upper surface of the external support and coupleable to the second body with the opening of the upper surface of the external support between the first body and the second body, and wherein the upper surface of the external support contacting the upper housing has a separate support groove corresponding to a shape of the upper housing.

2. The dishwasher as claimed in claim 1, wherein the drain port is in a predetermined area of the first body, and the second body includes a drain housing having an opening at a position opposite to a position of the drain port.

3. The dishwasher as claimed in claim 2, wherein the first body further includes a valve at an upper portion of the drain port to selectively open or close an upper portion of the first body, and while the second body is coupled to the first body, the valve moves downward so that a flow path is formed between the drain housing and the drain port.

4. The dishwasher as claimed in claim 3, wherein the first body includes a fixing plate positioned above a center of the drain port, with an upper surface of the fixing plate having an area smaller than a cross-sectional area of the drain port, the valve has a shape to surround the fixing plate, and while the second body is decoupled from the first body, the valve is positioned on a side surface of the fixing plate by moving upward.

5. The dishwasher as claimed in claim 4, wherein the second body further includes a fixing groove formed in a central portion of the drain housing, and the fixing groove has a bent shape corresponding to a shape of the fixing plate to fix the second body in contact with the fixing plate while the second body is coupled to the first body.

6. The dishwasher as claimed in claim 4, wherein the first body includes a coupling housing at the upper portion of the first body, and having a shape to support the second body while the second body is coupled to the first body, and surround the valve when the second body is decoupled from the first body.

7. The dishwasher as claimed in claim 6, wherein while the second body is decoupled from the first body, the fixing plate, the valve, and the coupling housing are be positioned on the same plane.

8. The dishwasher as claimed in claim 1, further comprising a cover configured to selectively cover the upper surface of the first body, wherein the cover covers the first body in a state where an upper surface of the cover is parallel to the upper surface of the external support.

9. The dishwasher as claimed in claim 8, wherein the cover has a shape corresponding to a shape of the upper surface of the first body and a shape of the upper surface of the second body to selectively cover one of the upper surface of the first body and the upper surface of the second body.

10. The dishwasher as claimed in claim 8, wherein the cover is coupled to the first body to open or close the upper surface of the first body in a door type.

11. The dishwasher as claimed in claim 1, wherein the rack includes a first rack and a second rack, the second body includes a first housing forming an exterior of the first rack, a second housing forming an exterior of the second rack, and a hinge connecting one side of the first housing and one side of the second housing to each other, and the other side of the first housing and the other side of the second housing are selectively joined together or separated from each other.

12. The dishwasher as claimed in claim 1, further comprising:

a sensor configured to detect whether the second body is coupled to the first body; and a control processor configured to operate the washing pump based on a detection result of the sensor.

13. The dishwasher as claimed in claim 1, further comprising a third body, wherein the second body further includes:

a joining member selectively joined to the third body; and a delivery channel configured to provide the water delivered from the supply channel to the third body.

14. The dishwasher as claimed in claim 13, wherein the spray nozzle is a first spray nozzle, the washing channel is a first washing channel and the third body further includes a second spray nozzle configured to spray water, and a second washing channel configured to receive the water delivered from the delivery channel, the second washing channel being connected to the second spray nozzle.

15. The dishwasher as claimed in claim 13, further comprising:

a sensor configured to detect whether the second body and the third body is coupled; and a control processor configured to control the washing pump to be operated at a first strength while the second body is coupled to the first body, and to be operated at a second strength stronger than the first strength while the first body and the third body are sequentially coupled to one another.

* * * * *